US005133170A

United States Patent [19]

Lewis et al.

[11] Patent Number: 5,133,170

[45] Date of Patent: Jul. 28, 1992

[54] APPARATUS FOR PACKING CIGARETTES AND OTHER SMOKING MATERIALS INTO PREFORMED HINGED LID PACKS

[75] Inventors: Robert T. Lewis; Kenneth M. Milliner, both of Macon, Ga.

[73] Assignee: Brown & Williamson Tabacco Corporation, Louisville, Ky.

[21] Appl. No.: 763,856

[22] Filed: Sep. 23, 1991

[51] Int. Cl.[5] ..... B65B 19/20

[52] U.S. Cl. ..... 53/252; 53/253; 53/284.5; 53/468; 53/566

[58] Field of Search ..... 53/468, 467, 473, 253, 53/252, 251, 250, 249, 375.3, 382.1, 284.5, 236

[56] References Cited

U.S. PATENT DOCUMENTS 2,991,605 7/1961 Pollmann ..... 53/253 X
3,854,270 12/1974 Cloud et al. ..... 53/252 X
3,896,606 7/1975 Utsumi ..... 53/253 X
4,947,617 8/1990 Focke et al. ..... 53/253 X
5,067,304 11/1991 Kuethe ..... 53/252 X

*Primary Examiner*—James F. Coan
*Attorney, Agent, or Firm*—Charles I. Sherman

[57] ABSTRACT

A packaging and conveying system for packaging a bundle of cigarettes or other smoking articles into a pre-formed pack. The system includes conveying means for conveying closed empty packs to a turret wheel having a plurality of slots wherein each slot is sized to receive an empty closed pack. Means are provided to remove the packs from the turret wheel at preselected locations in alignment with means to open the pack. The open packs are then conveyed to a bundle inserting station wherein a bundle of cigarettes are inserted into the packs. From the bundle inserting station, the packs are conveyed to a package closure means and then conveyed away to storage or further packing for shipment.

9 Claims, 3 Drawing Sheets

APPARATUS FOR PACKING CIGARETTES AND OTHER SMOKING MATERIALS INTO PREFORMED HINGED LID PACKS

BACKGROUND OF THE INVENTION

The present invention relates to an apparatus for packing cigarettes and other smoking articles into preformed hinged lid packs. More particularly, the invention relates to an improved arrangement of apparatus adapted to receive a steady stream of closed empty packs having hinged lid tops with means to open the tops and insert cigarettes or other smoking articles therein, close the top and move the closed packs away for packing and shipping.

In the prior art there are many known devices and apparatuses for packing cigarettes and other smoking articles into empty packs under high speed manufacturing and packaging conditions. In fact, one of the primary factors in the success of manufacturing of relatively small packages of consumer goods, is the ability to quickly and effectively package the product for shipment at the lowest possible cost. This lowest possible cost includes both the upkeep on the equipment and the intensity of labor necessary to package the goods. Moreover, with increasingly improved techniques for high speed manufacture and packaging of consumer goods, it has been found that the higher the speed of the machines, the more costly and complex are the machines to obtain these high production rates. This is particularly true in the cigarette industry where great strides have been made in high speed techniques for dispensing the product into consumer sized packages. However, high speed machines presently in use for packaging have been extremely complex and costly, and generally it is difficult to justify the increased cost for the increased speed and capacity. Furthermore, most of the conventional apparatus presently available suffers drawbacks of frequent breakdowns as well as the reliability of parts which are readily susceptible for rapid maintenance and replacement in view of these breakdowns. Thus, the cigarette industry is always looking for simplistic means of packing their cigarette articles at high speed with the minimum amount of labor and with a minimum amount of maintenance.

SUMMARY OF THE INVENTION

It is a primary object of the present invention to provide a packaging apparatus for cigarette articles which is simple, high speed and easily maintained.

It is another object of the present invention to provide an apparatus to open empty cigarette packs and insert smoking articles therein, close and seal the packs, all in a substantially continuous, automatic and efficient manner at high speeds.

More particularly, the present invention provides a packaging and conveying system for packaging a bundle of cigarettes into a pre-formed pack comprising a first conveyor means having a tray thereon with a plurality of packs therein; a second conveyor means having a feed end adjacent to and aligned with a discharge end of the first conveyor means, the second conveyor means including tray stripping means; a second conveyor means discharge chute having a feed end at a discharge end of said second conveyor means; a turret wheel having a plurality of slots therein, each slot sized to receive a pack from the discharge chute, the discharge chute having a discharge end aligned with the turret wheel; a turret wheel pack removal means positioned to remove packs from the turret wheel; pack opening means in alignment with the turret wheel pack removal means; first package moving means positioned to move packs from the turret wheel pack removal means to a bundle inserting means; bundle inserting means positioned to insert bundles into the open package; second package moving means positioned to move packs from the bundle inserting means to a package closure means; and means to take packs away from said package closure means.

DESCRIPTION OF A PREFERRED EMBODIMENT

Figure 1:
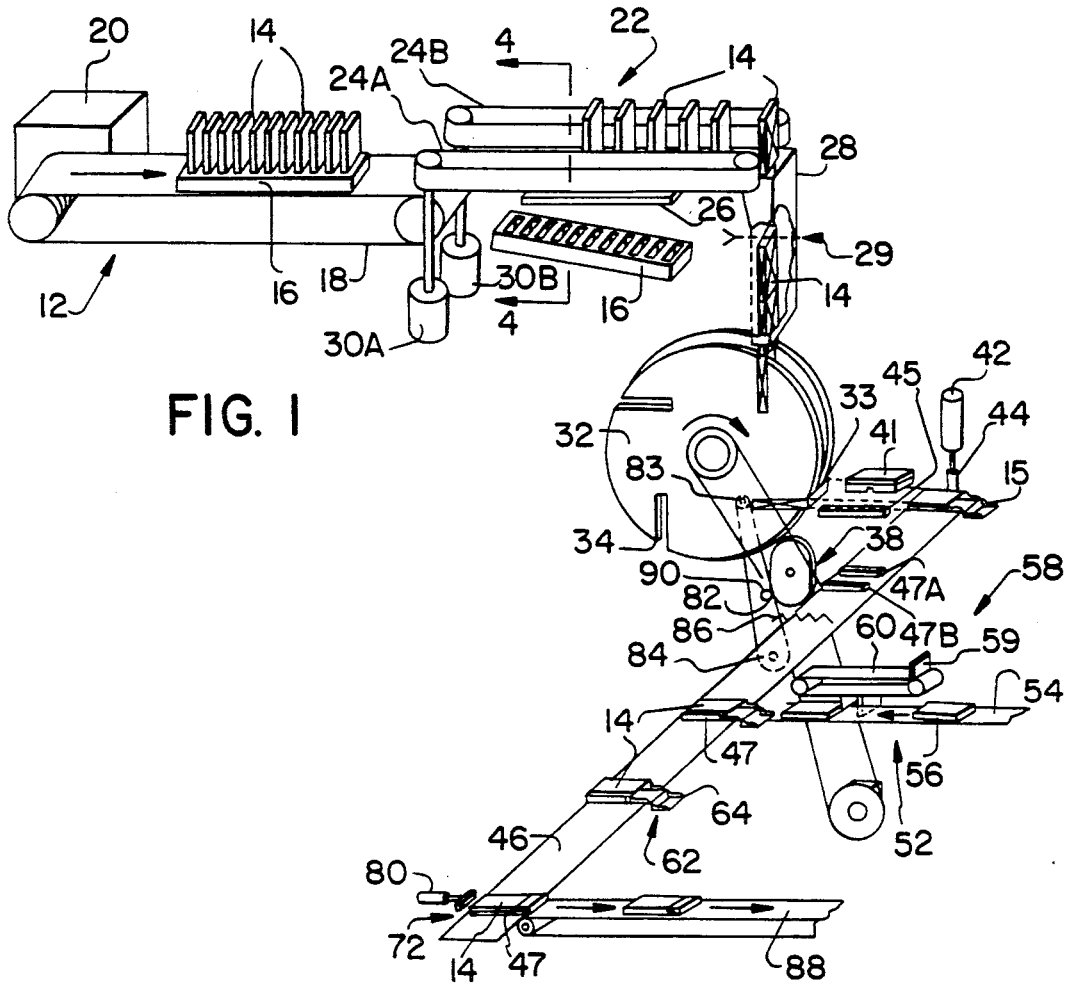
FIG. 1 schematically shows one preferred apparatus of the present invention.
Figure 3:
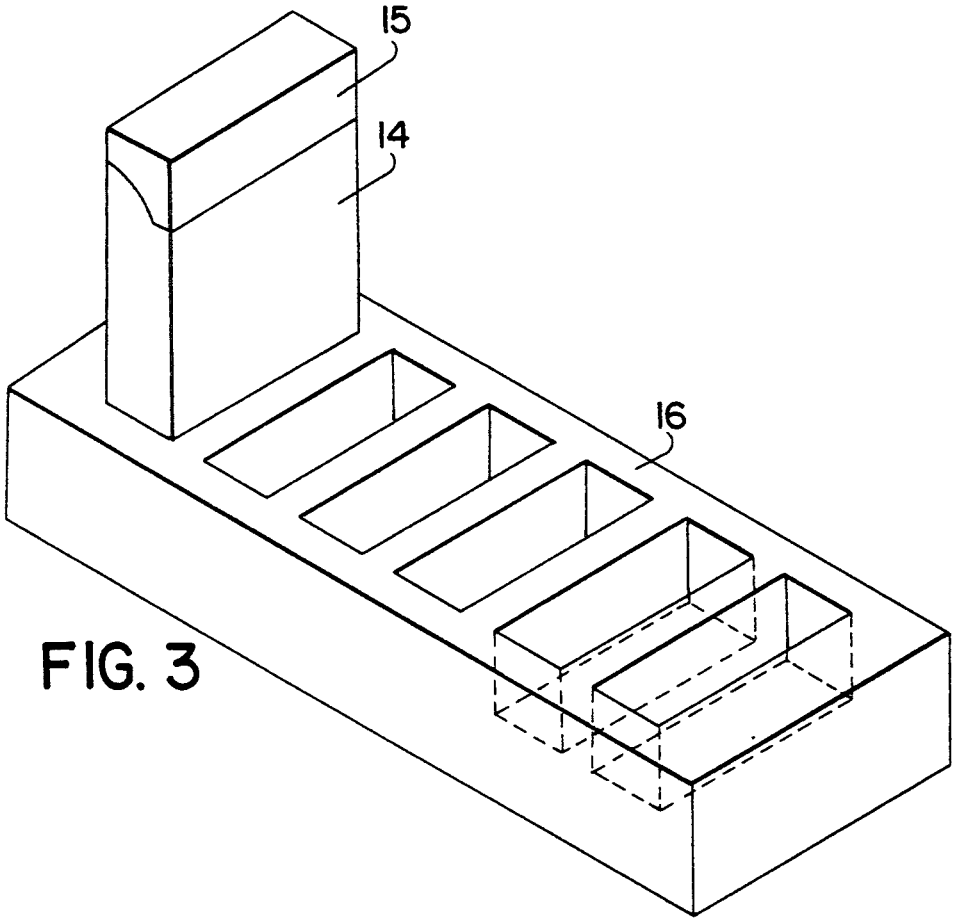
FIG. 3, shows an enlarged perspective view of a preferred tray for feeding empty packages to an apparatus of the present invention.

Referring to FIG. 1, a first conveyor 12 is provided to convey empty pre-formed cigarette or other smoking article packs 14 to a second or feed conveyor means 22 for subsequent insertion into a turret wheel 32. The first conveyor 12 is a conventional conveyor including an endless belt 18 which is driven by a conventional drive motor means 20. And, the packs 14 are transported along conveyor 12 in a tray 16. One preferred tray is shown in FIG. 3.

Figure 4:
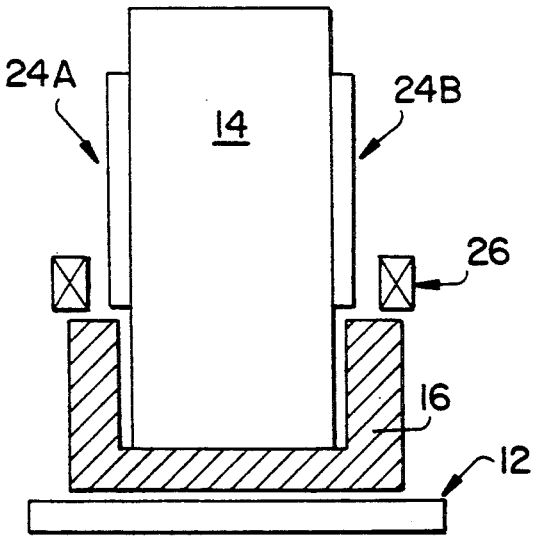
FIG. 4 is an enlarged cross-sectional view of an element of the present invention as taken along lines 4—4 in FIG. 1.

The second conveyor means 22, as shown in FIGS. 1 and 4, includes pair of vertically disposed and spaced apart endless belt conveyor means 24A and 24B. The spacing between the conveyor belts 24A and 24B is substantially the same as the width of a package 14. The second conveyor means 22, is also provided with a stationarily mounted tray stripper 26 which includes two horizontally positioned bars on opposite sides of the conveyor 22 extending parallel to and positioned along the lower outside extremity of the conveyor belts 24A and 24B. The tray stripper 26 positioned above the trays 16 is positioned above the tray 16 so the trays 16 slide underneath the stripper 26 leaving the empty packs 14 disposed above the tray 16 wherein the belts 24A, 24B through frictions move packs 14 toward the discharge end of the second conveyor 22. At the end of the conveyor 22 the packs 14 are fed or enter into a vertically disposed down drop chute 28 which feeds the turret wheel 32, to be discussed herein.

The conveyor belts 24A and 24B are motor driven by motors 30A and 30B respectively, wherein the motors 30A and 30B are intermittently operated in response to an electronic eye beam means 29 which is disposed in the upper portion of the chute 28. Packs 14 are disposes vertically end-to-end, in the chute 28 and when the level of packs is below the electronic eye beam, the signal from the eye beam source activates motors 30A and 30B until the packs 14 reach a level that breaks the eye beam in the electronic eye beam means 29.

The vertically disposed down drop chute 28 has an enlarged opening at the top or feed end to receive the packs 14 and the lower portion has an inside cross sectional area substantially the same as the cross sectional area of the cigarette packs 14 which are going to be fed therethrough. The packs 14 are disposed in a lengthwise position and extend from the turret wheel 32 upwards to the electronic eye beam source 29.

Figure 5:
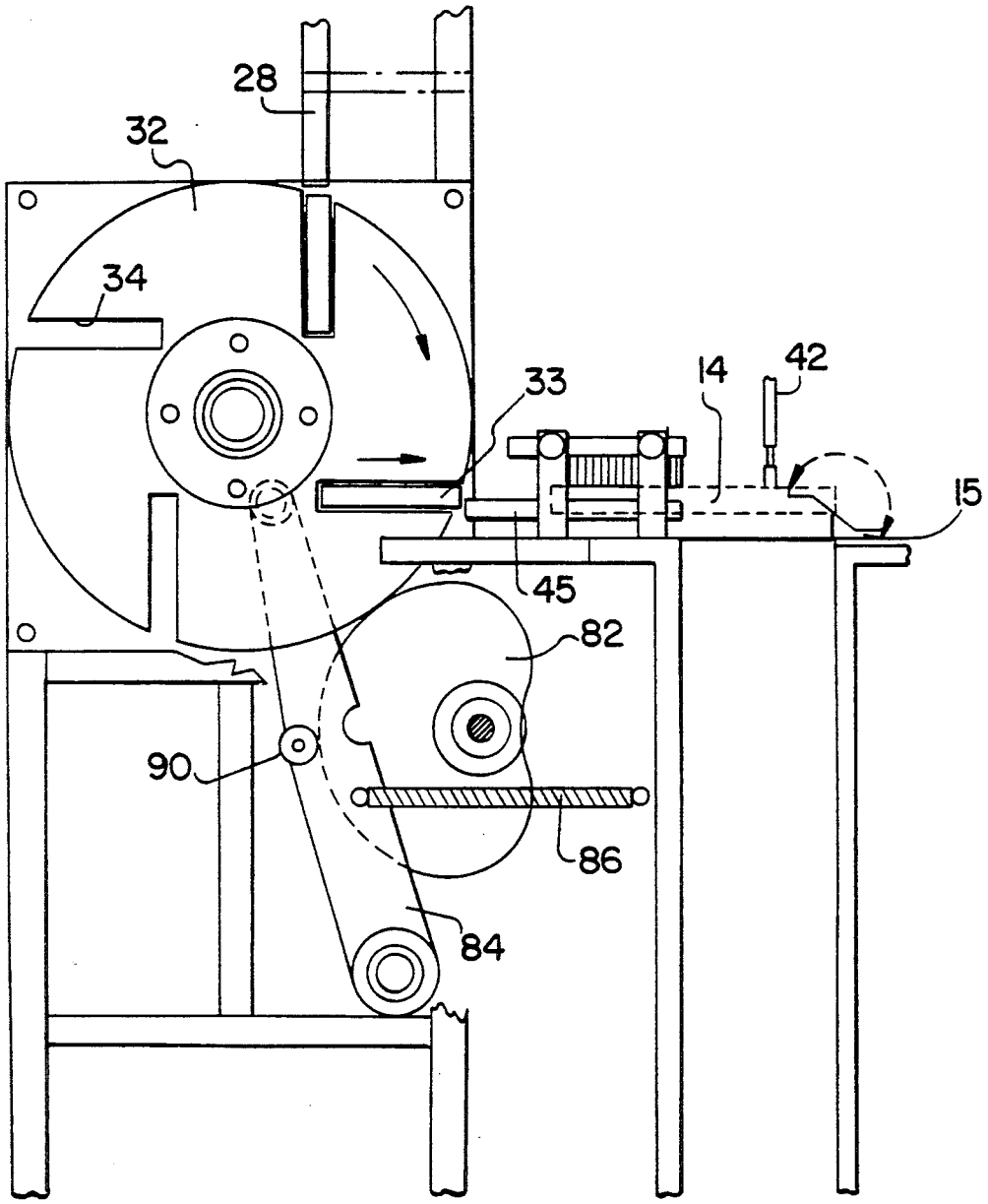
FIG. 5 is a side view of a preferred turret wheel used in the present invention.

The turret wheel 32 as shown in FIG. 1 and 5 is provided with a plurality of slots 34 therein, wherein the slots 34 are substantially the same width and thickness of the cigarette packs to be received therein.

The turret wheel 32 is generally motor driven by, for example, indexing drive motor 36 which drives the turret wheel 32 in a synchronized cooperating relationship with a cam assembly 38. The cam assembly 38 includes the motor driven cam 82 which is elliptically shaped and rotates against a spring loaded lever 84. The motorized cam 82 is synchronized so that with the movement of the turret wheel 32 to a preselected position 33 the cam operated lever 84, moving in response to the turning of the cam 82 shoves a pack 14 out of the turret.

The lever 84, which is operable in response to the cam 82, includes a spring assembly 86 which maintains constant pressure of the lever 84 against the cam 82 during the rotating movement of the cam 82. The package discharge position 33 of the turret wheel 32 is in horizontal alignment with an indexing endless belt conveyor 46 so that as packs 14 are discharged from turret wheel 32, conveyor 46 can be positioned to receive said packs 14. Hold down means shown as an elongated brush assembly 41 is provided between the discharge position 33 and the conveyor 46 to maintain vertical alignment of packs 14 as they move from the turret wheel 32 to the conveyor 46. The brush assembly 41 includes brush 43 mounted above the discharge position 33 and a flat plat member 45 which bridges the gap between the turret wheel 32 and the conveyor 46. As the packs 14 are discharged from turret wheel 32 they slide across member 45 by the force of the next discharging pack 14 from the turret wheel 32.

The indexing conveyor 46 is provided with pack receiving means 47 therein which is shown as a pair of transversely spaced elongated members 47A and 47B on conveyor 46, the spacing between the members 47A and 47B being substantially the same as the width of a package 14.

A pack opening means 42 is provided adjacent to the discharge position 33 of the turret wheel 32 to receive the packs 14 as they are ejected from the slots 34 in the turret wheel 32. The pack opening means includes a reciprocal vertically disposed opening punch 44. Punch 44 is positioned above the conveyor 46 and particularly the pack receiving means 47. The indexing endless belt conveyor 46 which is intermittently movable in response to preselected timing device, not shown, cooperates with the reciprocating punch 44 so that the conveyor 46 is stationery as the punch 44 moves in its reciprocating movement thereby opening the pack 14. Upon the punch 44 returning to its most upward position, the conveyor 46 then moves a preselected distance sufficient to receive another pack 14 which is subsequently opened by the punch 46. The positioning of the punch 46 over the pack receiving means 47 is directly related to the type of connection holding the hinged-lid of the pack 14 in its closed position. For example, if the lid is held in a closed position by friction means, the punch 44 is positioned to strike the pack just below the "C" junction of the lid edge with the body of the pack, thereby squeezing the body inward, breaking the friction connection and popping the lid into an open position.

After the pack 14 is opened, the conveyor 46 moves the opened pack 14 to a bundle inserting means station 52 which includes the feed means for feeding bundles 56 of cigarettes or other smoking articles into the opened packs 14. A bundle feed conveyor 54 is provided transverse to the conveyor 46 for feeding the cigarette bundles 56 to the open packs 14. An overhead conveyor 58 is provided to feed the cigarette bundles 56 into the open packs 54. The overhead conveyor 58 includes an endless belt 60 with spaced outwardly extending pushers 59 thereon. The overhead conveyor 58 is positioned just above the bundle feed conveyor 54 so that the pusher 59 will engage the cigarette bundles 56 and as the endless belt 60 moves toward the conveyor 46 the pusher 59 engages with each cigarette bundle forcing the cigarette bundle into the pack 14 on the conveyor 46.

The overhead conveyor 58 includes a motor (not shown) which is in synchronization or cooperating relationship with the indexing conveyor 46 so that the conveyor 46 is stopped while the overhead conveyor 58, with the pusher 59, forces the cigarette bundle 56 into the packs 14 during the non-movement of the conveyor 46.

Downstream from the bundle inserting means is a package closing means 62 exemplified by a spiral ramp 64 which is positioned along the conveyor 46 and at an angle thereto so that as the packs 14 move down the conveyor the vertically extending ramp 64 member engages with the open hinged lid and forces the hinged lid into a closed position as it moves past the ramp 64. The ramp 64 is shown as a rod which starts below the conveyor 46 and spirals upward and over the edge of the conveyor 46 engaging the lid of the pack 14, forcing the lid into a closed position.

At the discharge end of the conveyor 46 is a pack take away conveyor means 88 which may be any known in the art. In the preferred embodiment, a piston 80 which may be, for example, cam operated or driven by an air cylinder is provided at the discharge end of the conveyor 46. In operation, as a pack of cigarettes 14 is positioned in front of the piston driven air cyclinder assembly 80, the air actuated cylinder 80, upon actuation, pushes the pack 14 off the conveyor 46 and onto a take away conveyor 88 which takes the packs to a further location for packing into a carton for shipping.

Figure 2:
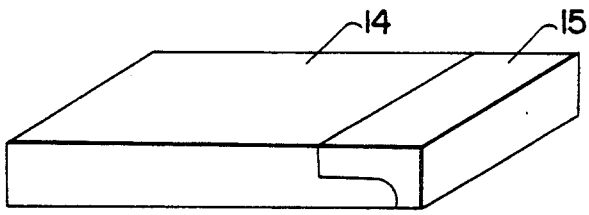
FIG. 2 shows a finished product of a package of smoking material which has been packaged in the apparatus of FIG. 1.

In the operation of the present invention, the packs 14 typically may be, for example, a plastic, or a cardboard box with a hinged lid opening as shown in FIG. 2. In FIG. 2, the preferred pack 14 is shown in a closed position which is the position the pack is in when it enters the feed conveyor for receiving a full bundle of cigarettes therein as well as the finished condition when it is removed by the take-away conveyor 88.

It will be realized that various changes ma be made to the specific embodiment shown and described without departing from the scope and principles of the present invention.

What is claimed is:

1. A packaging and conveying system for packaging a bundle of cigarettes or other smoking articles into a pre-formed pack comprising:

(a) A first conveyor means having a tray thereon, said tray including a plurality of packs therein;

(b) A second conveyor means having a feed end adjacent to and aligned with a discharge end of said first conveyor means, said second conveyor means including tray stripping means;

(c) A second conveyor means discharge chute having a feed end at a discharge end of said second conveyor means;

(d) A turret wheel having a plurality of slots therein, each slot sized to receive a pack from said discharge chute, said discharge chute having a discharge end aligned with said turret wheel;

(e) A turret wheel pack removal means positioned to remove packs from said turret wheel;

(f) Pack opening means in alignment with said turret wheel pack removal means;

(g) First package moving means positioned to move packs from said turret wheel pack removal means to a bundle inserting means;

(h) Bundle inserting means positioned to insert bundles into said open package;

(i) Second package moving means positioned to move packs from said bundle inserting means to a package closure means;

(j) Pack closure means; and, (k) Means to take packs away from said apparatus.

2. The system of claim 1 wherein said turret wheel pack removal means includes a cam operated lever cooperatively associated with said turret wheel, said cam operated lever positioned to shove packs out of said turret wheel slot at a preselected location of said turret wheel.

3. The system of claim 1 wherein said bundle inserting means includes an overhead conveyor with vertically extending pushers mounted on said conveyor, said pushers positioned to engage with bundles when said first package moving means is in a preselected position, said overhead conveyor being in cooperative relationship with the movement of said first package moving means.

4. The system of claim 1 wherein said package closure means includes a vertically extending ramp member angularly disposed with said second package moving means.

5. The system of claim 1 wherein said first package moving means and said second package moving means are unitary.

6. The system of claim 1 wherein said first package moving means and said second package moving means are a third conveyor means.

7. The system of claim 1 wherein said pack is a hinged-lid pack.

8. The system of claim 1 wherein said pack opening means includes a vertically reciprocating punch.

9. The system of claim 1 wherein said pack closure means includes a spiral ramp having its upstream end beneath the second package moving means and its downstream end spiraling above and inwardly of the second package moving means.

* * * * *